US010746467B2

(12) United States Patent
Halkola et al.

(10) Patent No.: US 10,746,467 B2
(45) Date of Patent: Aug. 18, 2020

(54) ROTARY BED-TYPE ELECTRIC FURNACE

(71) Applicant: OUTOTEC (FINLAND) OY, Espoo (FI)

(72) Inventors: Jari Halkola, Espoo (FI); Seija Kurki, Helsinki (FI); Kristian Lillkung, Helsinki (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 16/743,387

(22) Filed: Jan. 15, 2020

(65) Prior Publication Data

US 2020/0158434 A1 May 21, 2020

Related U.S. Application Data

(63) Continuation of application No. PCT/FI2017/050549, filed on Jul. 21, 2017.

(51) Int. Cl.

| | |
|---|---|
| ***F27B 9/06*** | (2006.01) |
| ***F27B 9/16*** | (2006.01) |
| ***C21B 13/08*** | (2006.01) |

(52) U.S. Cl.

CPC ..... *F27B 9/062* (2013.01); *C21B 13/08* (2013.01); *F27B 9/16* (2013.01)

(58) Field of Classification Search

CPC ..... F27B 9/062; F27B 9/16; C21B 13/08
USPC ..... 266/255, 177, 173; 432/152, 133, 138, 432/199, 242, 247, 254.2
See application file for complete search history.

(56) References Cited

U.S. PATENT DOCUMENTS 1,903,909 A 4/1933 Cope et al.
4,154,433 A * 5/1979 Kato ..... C21D 1/74 266/251

(Continued)

FOREIGN PATENT DOCUMENTS

CN 106433704 A 2/2017
DE 2045696 A1 3/1972

(Continued)

OTHER PUBLICATIONS

International Search Report issued by the Finnish Patent and Registration Office acting as the International Searching Authority in relation to International Application No. PCT/FI2017/050549 dated Nov. 15, 2017 (5 pages).

(Continued)

*Primary Examiner* — Jessee R Roe
*Assistant Examiner* — Michael Aboagye
(74) *Attorney, Agent, or Firm* — Robert P. Michal, Esq.; Carter, DeLuca & Farrell LLP

(57) ABSTRACT

A rotary bed-type electric furnace includes a rotary bed configured to carry material, and a rotator configured to rotate the rotary bed so that material carried on the rotary bed passes through peripheral zones of the rotary bed-type electric furnace. The peripheral zones include a feeding zone configured to receive material on the rotary bed, a drying zone configured to dry and heat material by means of electrical energy, a heating zone configured to heat material by means of electrical energy, a cooling zone configured to lower the temperature of the material and configured to release gases from the material, and a discharging zone configured to discharge material from the rotary bed of the furnace.

18 Claims, 4 Drawing Sheets

(56) References Cited

U.S. PATENT DOCUMENTS

| | | | | |
|---|---|---|---|---|
| 7,806,959 | B2 * | 10/2010 | Ito | B22F 9/06 75/477 |
| 8,012,236 | B2 * | 9/2011 | Tokuda | C21B 13/0006 75/475 |
| 2002/0027317 | A1 | 3/2002 | Imaizumi | |
| 2007/0227301 | A1 | 10/2007 | Ito et al. | |
| 2012/0264074 | A1 | 10/2012 | Gockel et al. | |
| 2013/0287942 | A1 | 10/2013 | Barnes et al. | |

FOREIGN PATENT DOCUMENTS

| | | | |
|---|---|---|---|
| JP | S5751220 | A | 3/1982 |
| JP | 2007246958 | A | 9/2007 |
| WO | 2012018394 | A2 | 2/2012 |

OTHER PUBLICATIONS

Written Opinion of the International Searching Authority issued by the Finnish Patent and Registration Office acting as the International Searching Authority in relation to International Application No. PCT/FI2017/050549 dated Nov. 15, 2017 (7 pages).

International Preliminary Report on Patentability issued by the Finnish Patent and Registration Office acting as the International Preliminary Examining Authority in relation to International Application No. PCT/FI2017/050549 dated Sep. 20, 2018 (5 pages).

Extended European Search Report issued by the European Patent Office in relation to European Application No. 17918275.3 dated Jun. 22, 2020 (8 pages).

Figure 1:
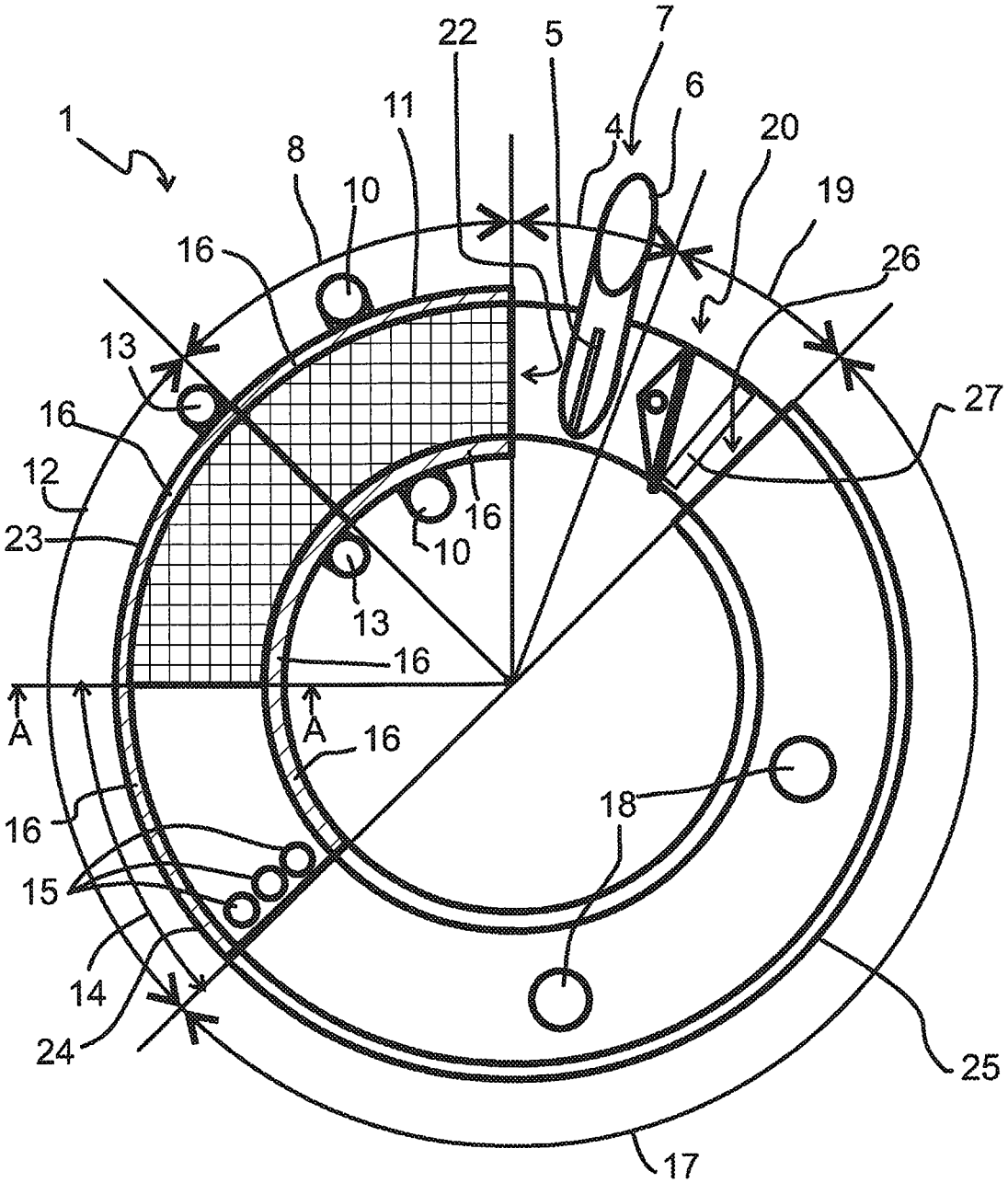

* cited by examiner (A-A FIG 1:)

ROTARY BED-TYPE ELECTRIC FURNACE

CROSS-REFERENCE TO RELATED APPLICATION

This application is a continuation of PCT International Application No. PCT/FI2017/050549 filed Jul. 21, 2017, the disclosure of this application is expressly incorporated herein by reference in its entirety.

FIELD OF THE INVENTION

The invention relates to a rotary bed-type electric furnace.

BACKGROUND ART

Various rotary bed-type furnaces are known in the art.

Publication US 2002/0027317 presents a reducing furnace that is in the form of a rotary bed-type furnace.

Publication CN106433704 A presents a system for pyrolysis of solid waste including a furnace that is in the form of a rotary bed-type furnace.

OBJECTIVE OF THE INVENTION

The object of the invention is to provide a rotary bed-type furnace that is suitable for example for recovering metal from activated carbon of suitable for roasting of anode slime for the purpose of recovering of selenium.

SHORT DESCRIPTION OF THE INVENTION

The rotary bed-type electric furnace is preferably automatically operated.

The rotary bed-type electric furnace is preferably designed for continuous operation, i.e. not batch operation Because electric heating is used in rotary bed-type electric furnace, temperatures are easy and fast to adjust.

The feeding speed of the feeding arrangement provided at the feeding zone and the rotating speed of the rotary bed are preferably, but not necessarily, steplessly adjustable so that a layer of material of uniform thickness can be formed on the rotary bed.

The cooling zone is preferably, but not necessarily, provided with an analyzing apparatus that is functionally connected with discharging means of the discharging zone and with the feeding arrangement of the feeding zone. Such analyzing apparatus is configured to analyze at least one of the color of the material that passes on the rotary bed thorough the cooling zone and the content of exhaust gases and if as a result of the analyzing for example a combustion of the material on the rotary bed has not occurred in a sufficient extent, the discharging means of the discharging zone is configured to not remove material from the rotatory bed and the feeding arrangement of the feeding zone is configured to not feed new material onto the rotary bed, and a result of this material is fed from the discharging zone to the feeding zone as carried on the rotary bed for an additional revolution in the rotary bed-type electric furnace.

LIST OF FIGURES

Figure 2:
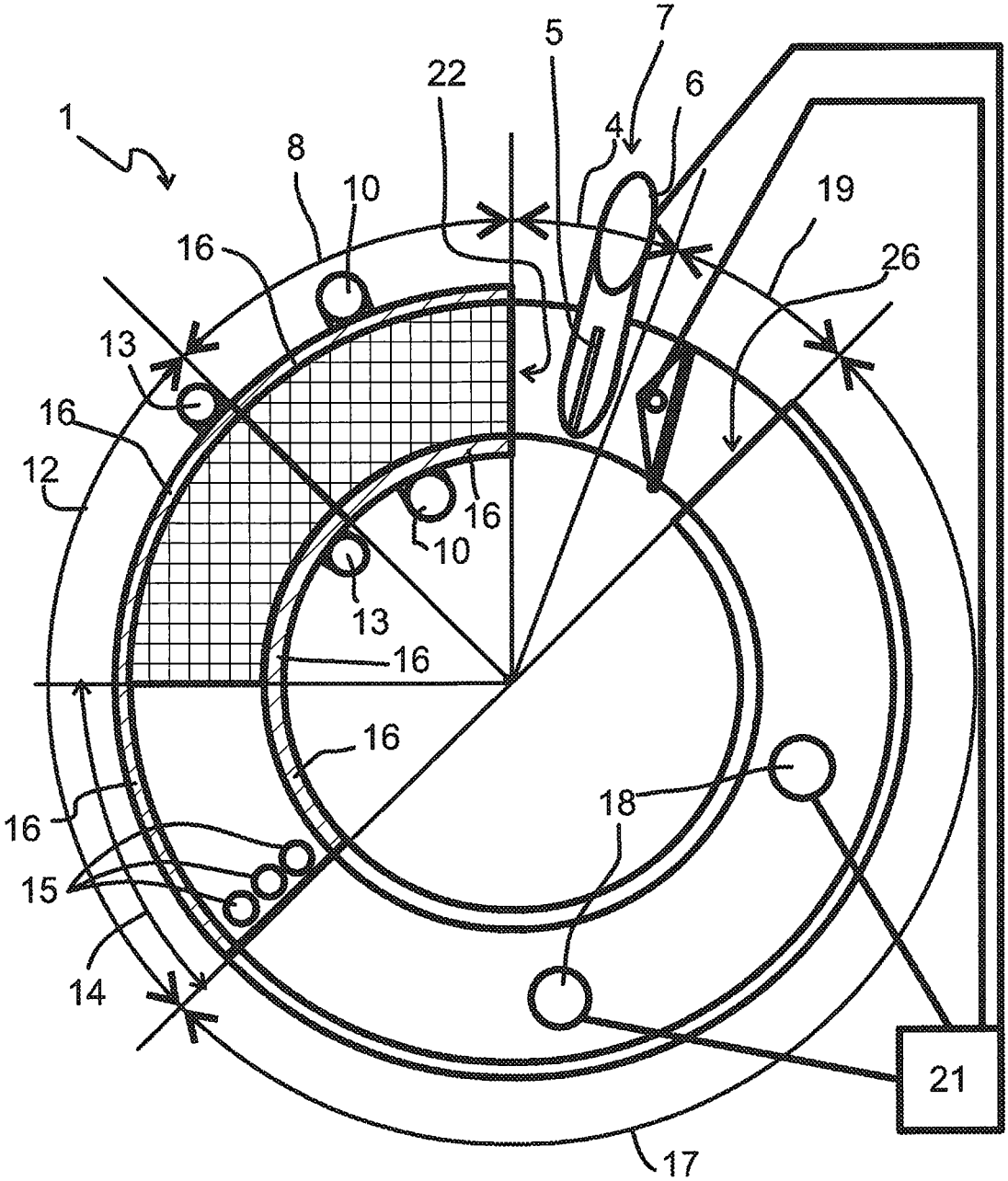
Figure 3:
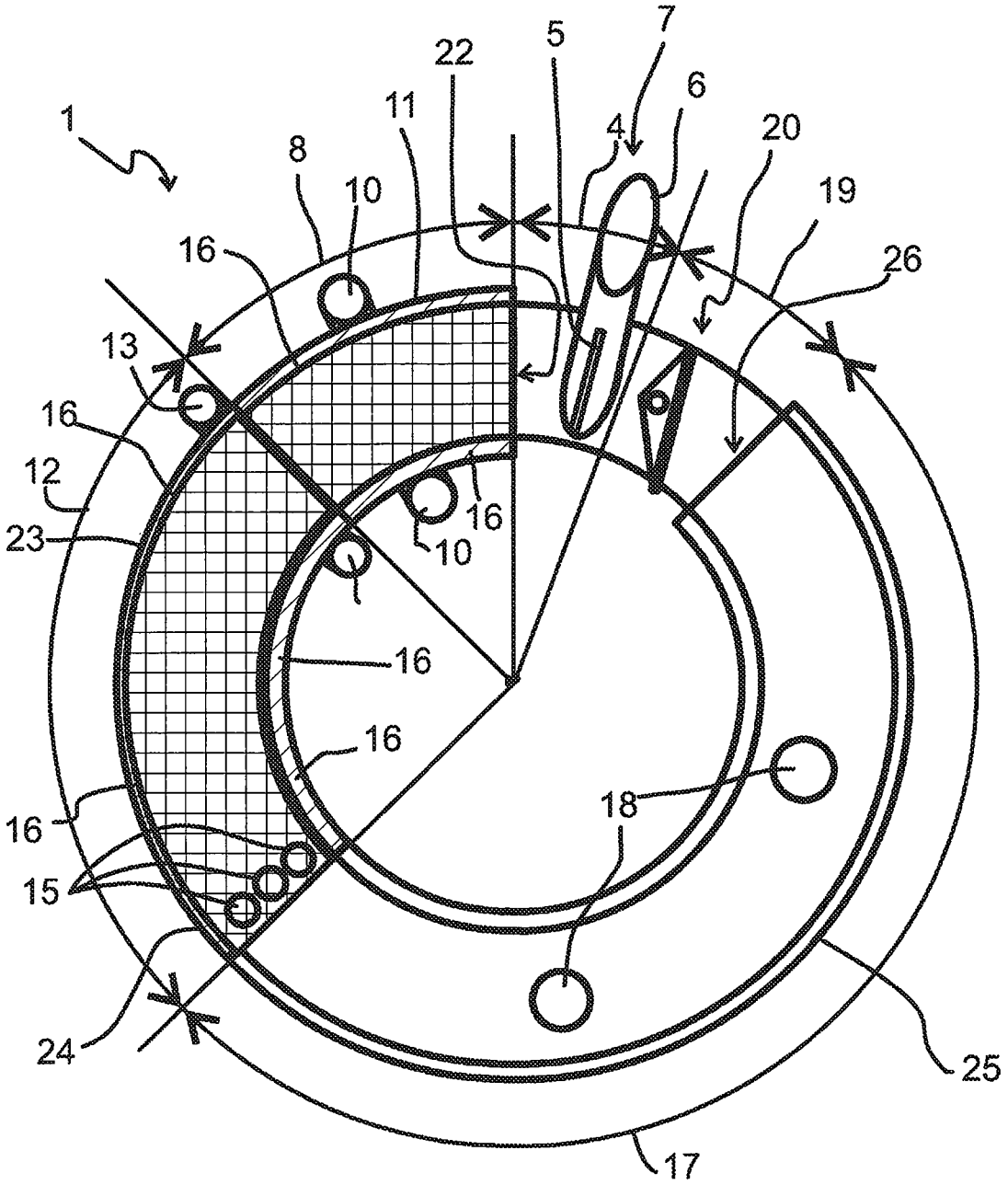
Figure 4:
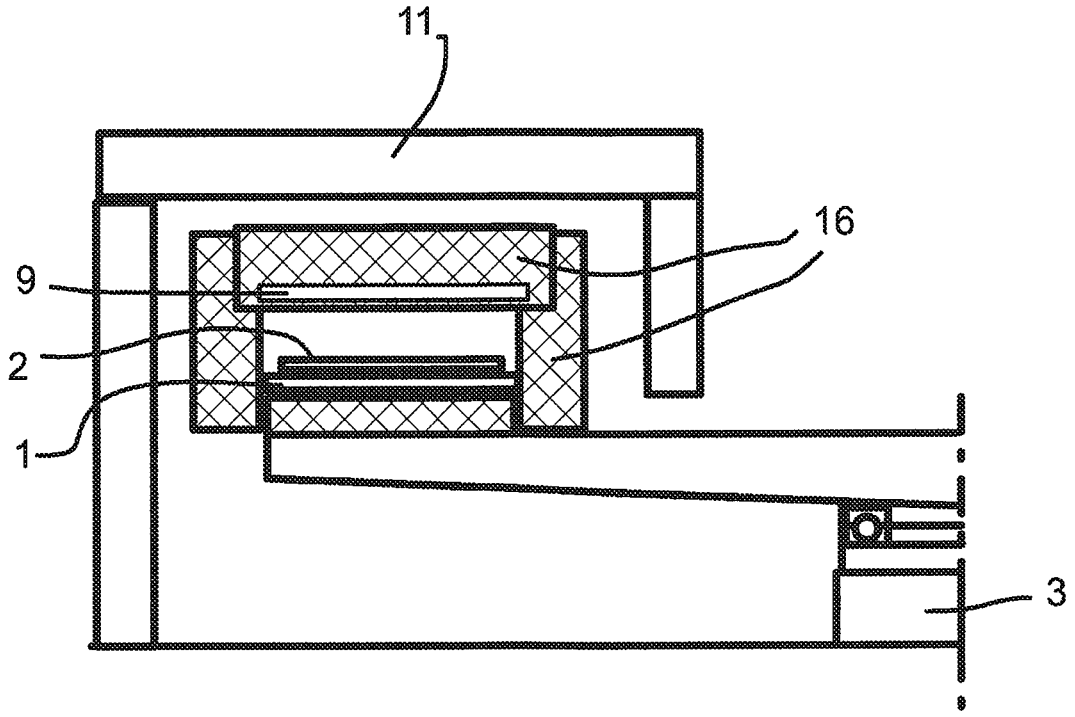

In the following the invention will described in more detail by referring to the figures, of which FIG. 1 is a schematic illustration of one embodiment of the rotary bed-type electric furnace, FIG. 2 is a schematic illustration of another embodiment of the rotary bed-type electric furnace, FIG. 3 is a schematic illustration of yet another embodiment of the rotary bed-type electric furnace, and FIG. 4 is a cross-section view of the rotary bed-type electric furnace at line A-A in FIG. 1.

DETAILED DESCRIPTION OF THE INVENTION

Next the rotary bed-type electric furnace and some embodiments and variants of the rotary bed-type electric furnace will be presented in greater detail.

The rotary bed-type electric furnace comprises a rotary bed 1 configured to carry material 2, and a rotator 3 configured to rotate the rotary bed I so that material 2 carried on the rotary bed 1 passes through peripheral zones of the rotary bed-type electric furnace. The rotator 3 is preferably, but not necessarily, configured to rotate the rotary bed 1 at a rotating speed that is steplessly adjustable. The rotator 3 is preferably an electric motor. The rotary bed 1 has preferably, but not necessarily, a flat material carrying surface (not marked with a reference numeral). An outer diameter of the rotary bed 1 can be between 2 and 3 m, such as about 2.5 m. A width of the rotary bed 1 in a peripheral direction can be 0.25 to 0.75 m, such as about 0.5 m. The rotator can be configured to rotate the rotary bed 1 at peripheral speeds (as measured at the outer or the inner diameter of the rotary bed 1) between 1 to 5 cm/s, such as between 2 and 3 cm/s.

The peripheral zones include a feeding zone 4 configured to receive material 2 for example through a discharge hole 5 of a storage bin 6 of a feeding arrangement 7 provided at the feeding zone 4 on the rotary bed 1 of the furnace. The feeding zone 4 can comprise a feeding arrangement 7 having a storage bin 6 provided with a discharge hole 5 in the form of an elongated material feeding aperture extending transversely above the rotary bed 1. The material 2 can for example be filtered and washed activated carbon powder containing metal such as gold or be selenium containing anode slime. The feeding arrangement 7 can be configured to form a material bed having a thickness between 5 and 15 mm such as about 15 mm on the rotary bed 1.

The peripheral zones include a drying zone 8 configured to receive material 2 from the feeding zone 4 and configured to dry and heat material 2 by means of electrical energy to a temperature between 50 and 300° C., such as to about 200° C. it is for example possible that stationary and/or removable electrical heating elements 9 are arranged at the drying zone 8 and configured to heat the material 2 on the rotary bed 1 of the furnace as the material 2 passes through the drying zone 8 as carried by the rotary bed 1 of the furnace. The drying zone 8 can be provided with first exhaust ducts 10 configured to lead vaporized matter formed in connection with the drying of the material 2 carried on the rotary bed 1 of the furnace from the drying zone 8. The drying zone 8 is preferably, but not necessarily thermally insulated by insulation 16 from the ambient space to save energy and/or to speed up the drying of the material 2. The drying zone 8 is preferably, but not necessarily covered by a first hood section 11 configured to prevent exhaust gases from escaping from the drying zone 8.

The peripheral zones include a heating zone 12 configured to receive material 2 from the drying zone 8 and configured to heat material 2 by means of electrical energy to a temperature between 300 and 700° C., such as to about 500° C. It is for example possible that stationary and/or removable electrical heating elements 9 are arranged at the heating zone 12 and configured to heat the material 2 on the rotary bed 1 of the furnace as the material 2 passes through the heating zone 12 as carried by the rotary bed 1 of the furnace. The heating zone 12 is preferably, but not necessarily, provided with an oxygen containing gas feeding system 13 configured to feed oxygen containing gas into the heating zone 12. The heating zone 12 is preferably, but not necessarily thermally insulated by insulation 16 from the ambient space to save energy and/or to speed up the heating of the material 2. The heating zone 12 is preferably, but not necessarily covered by a second hood section 23 configured to prevent exhaust gases from escaping from the heating zone 12.

The heating zone 12 can include a combustion sector 14 at a downstream end of the heating zone 12 and configured to combust material 2 in presence of oxygen containing gas. The combustion sector 14 is preferably, but not necessarily, provided with second exhaust ducts 15 configured to lead exhaust gases formed in connection with the combustion of the material 2 carried on the rotary bed 1 of the furnace from the combustion sector 14 of the combustion zone 12. The combustion sector 14 of the heating zone 12 is preferably, but not necessarily thermally insulated by insulation 16 from the ambient space to save energy and/or to speed up the heating of the material 2. The combustion sector 14 of the heating zone 12 is preferably, but not necessarily covered by a third hood section 24 configured to prevent exhaust gases from escaping from the combustion sector 14 of the heating zone 12.

The peripheral zones include a cooling zone 17 configured to receive material 2 from the heating zone 12 and configured lower the temperature of the material 2 and configured to release gases from the material 2 carried on the rotary bed 1 of the furnace. The cooling zone 17 is preferably, but not necessarily, provided with third exhaust ducts 18 configured to lead exhaust gases formed in connection with the cooling of the material 2 carried on the rotary bed 1 of the furnace from the cooling zone 17. The cooling zone 17 is preferably, but not necessarily, covered by a fourth hood section 25 configured to prevent exhaust gases from escaping from the cooling zone 17.

The peripheral zones include a discharging zone 19 configured to receive material 2 from the cooling zone 17 and configured to discharge material 2 from the rotary bed 1 of the furnace by means of discharging means 20. The discharging means 20 of the discharging zone 19 can comprise a knife or a brush or the like scraper means configured to remove material 2 from the rotary bed 1. The discharging means 20 of the discharging zone 19 can comprise a vacuum arrangement 27 configured to remove material 2 from the rotary bed 1.

The cooling zone 17 if preferably, but not necessarily, provided with an analyzing apparatus 21 that is functionally connected with discharging means 20 of the discharging zone 19 and with the feeding arrangement 7 of the feeding zone 4. The analyzing apparatus 21 is configured to analyze at least one of the color of the material 2 that passes on the rotary bed 1 thorough the cooling zone 17 and the content of exhaust gases and if as a result of the analyzing for example a combustion of the material 2 on the rotary bed 1 has not occurred in a sufficient extent, the discharging means 20 of the discharging zone 19 is configured to not remove material 2 from the rotatory bed and the feeding arrangement 7 of the feeding zone 4 is configured to not feed new material 2 onto the rotary bed 1, and a result of this material 2 is fed from the discharging zone 19 to the feeding zone 4 as carried on the rotary bed 1 for an additional revolution in the rotary bed-type electric furnace.

A first curtain arrangement 22 is preferably, but not necessarily, provided between the feeding zone 4 and the drying zone 8 to prevent exhaust gases from escaping from the furnace between the feeding zone 4 and the drying zone 8. The first curtain arrangement 22 can comprise a wall element (not shown in the figures) and a lower flexible element (not shown in the figures) attached to the wall element.

A second curtain arrangement 26 is preferably, but not necessarily, provided between the cooling zone 17 and the discharging zone 19 so at to prevent exhaust gases from escaping from the furnace between the cooling zone 17 and the discharging zone 19. The second curtain arrangement 26 can comprise a wall element (not shown in the figures) and a lower flexible element (not shown in the figures) attached to the wall element.

The combustion sector 14 of the heating zone 12 can comprise a plurality of combustion modules.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. A rotary bed electric furnace, comprising:

a rotary bed having a material carrying surface configured to carry material to be heated in the rotary bed electric furnace, and a rotator configured to rotate the rotary bed so that material carried on the material carrying surface of the rotary bed passes through peripheral zones of the rotary bed electric furnace, wherein the peripheral zones include:

a feeding zone configured to receive the material on the material carrying surface of the rotary bed, a drying zone configured to receive the material carried on the material carrying surface of the rotary bed from the feeding zone and configured to dry and heat the material carried on the material carrying surface of the rotary bed by means of electrical energy to a temperature between 50 and 300° C., a heating zone configured to receive the material carried on the material carrying surface of the rotary bed from the drying zone and configured to heat the material carried on the material carrying surface of the rotary bed by means of electrical energy to a temperature between 300 and 700° C., a cooling zone configured to receive the material carried on the material carrying surface of the rotary bed from the heating zone and configured lower the temperature of the material carried on the material carrying surface of the rotary bed and configured to release gases from the material carried on the material carrying surface of the rotary bed, and a discharging zone configured to receive the material carried on the material carrying surface of the rotary bed from the cooling zone and configured to discharge the material carried on the material carrying surface of the rotary bed from the material carrying surface of the rotary bed, the drying zone being covered by a first section hood configured to prevent gases from escaping from the drying zone, the heating zone being covered by a second hood section configured to prevent gases from escaping from the heating zone, the cooling zone being covered by a third hood section configured to prevent gases from escaping from the cooling zone, wherein the first, second, and third hood sections are fixed relative to the drying, heating, and cooling zones, respectively, such that the rotary bed is configured to rotate relative to the first, second, and third hood sections, a first curtain arrangement between the feeding zone and the drying zone to prevent exhaust gases from escaping from the furnace between the feeding zone and the drying zone, and a second curtain arrangement between the cooling zone and the discharging zone to prevent exhaust gases from escaping from the furnace between the cooling zone and the discharging zone.

2. The rotary bed electric furnace according to claim 1, wherein the rotator is configured to rotate the rotary bed at a rotating speed that is steplessly adjustable.

3. The rotary bed electric furnace according to claim 1, wherein the drying zone is thermally insulated with insulation.

4. The rotary bed electric furnace according to claim 1, wherein the heating zone is thermally insulated with insulation.

5. The rotary bed electric furnace according to claim 1, wherein the drying zone is provided with first exhaust ducts configured to lead vaporized matter formed in connection with the drying of the material carried on the material carrying surface of the rotary bed from the drying zone.

6. The rotary bed electric furnace according claim 1, wherein the heating zone is provided with an oxygen containing gas feeding system configured to feed oxygen containing gas into the heating zone.

7. The rotary bed electric furnace according to claim 1, wherein the heating zone is provided with second exhaust gas ducts configured to lead exhaust gas formed in connection with the heating of the material carried on the material carrying surface of the rotary bed from the heating zone.

8. The rotary bed electric furnace according claim 1, wherein the cooling zone is provided with third exhaust gas ducts configured to lead exhaust gas formed in connection with the cooling of the material carried on the material carrying surface of the rotary bed from the cooling zone.

9. The rotary bed electric furnace according to claim 1, wherein the discharging zone comprises discharging means comprising a knife or a brush or the like scraper means configured to remove the material from the material carrying surface of the rotary bed.

10. The rotary bed electric furnace according to claim 1, wherein the discharging zone comprises discharging means comprising a vacuum arrangement configured to remove the material from the material carrying surface of the rotary bed.

11. The rotary bed electric furnace according to claim 1, wherein the feeding zone comprises a feeding arrangement provided with an elongated material feeding aperture extending transversely above the rotary bed.

12. The rotary bed electric furnace according to claim 1, wherein:

the heating zone comprises a combustion section at a downstream end of the heating zone, and the combustion section of the heating zone being configured to combust material in presence of oxygen containing gas.

13. The rotary bed electric furnace according to claim 1, further comprising an analyzing apparatus configured to analyze at least one of a color of the material or a content of the exhaust gases.

14. The rotary bed electric furnace according to claim 13, wherein the discharging zone is configured to not remove the material from the rotary bed upon the analyzing apparatus determining that a combustion of the material has not occurred to a threshold extent.

15. The rotary bed electric furnace according to claim 14, wherein the feeding zone is configured to not feed new material onto the rotary bed upon the analyzing apparatus determining that the combustion of the material has not occurred to the threshold extent.

16. The rotary bed electric furnace according to claim 1, wherein the material carrying surface is flat and annular.

17. A rotary bed electric furnace, comprising:

a rotary bed having a material carrying surface configured to carry material to be heated in the rotary bed electric furnace, and a rotator configured to rotate the rotary bed so that material carried on the material carrying surface of the rotary bed passes through peripheral zones of the rotary bed electric furnace, wherein the peripheral zones include:

a feeding zone configured to receive the material on the material carrying surface of the rotary bed, a drying zone configured to receive the material carried on the material carrying surface of the rotary bed from the feeding zone and configured to dry and heat the material carried on the material carrying surface of the rotary bed by means of electrical energy to a temperature between 50 and 300° C., a heating zone configured to receive the material carried on the material carrying surface of the rotary bed from the drying zone and configured to heat the material carried on the material carrying surface of the rotary bed by means of electrical energy to a temperature between 300 and 700° C., a cooling zone configured to receive the material carried on the material carrying surface of the rotary bed from the heating zone and configured lower the temperature of the material carried on the material carrying surface of the rotary bed and configured to release gases from the material carried on the material carrying surface of the rotary bed, and a discharging zone configured to receive the material carried on the material carrying surface of the rotary bed from the cooling zone and configured to discharge the material carried on the material carrying surface of the rotary bed from the material carrying surface of the rotary bed, the drying zone being covered by a first section hood configured to prevent gases from escaping from the drying zone, the heating zone being covered by a second hood section configured to prevent gases from escaping from the heating zone, the cooling zone being covered by a third hood section configured to prevent gases from escaping from the cooling zone, a first curtain arrangement between the feeding zone and the drying zone to prevent exhaust gases from escaping from the furnace between the feeding zone and the drying zone, and a second curtain arrangement between the cooling zone and the discharging zone to prevent exhaust gases from escaping from the furnace between the cooling zone and the discharging zone, the rotary bed electric furnace further comprising an analyzing apparatus configured to analyze at least one of a color of the material or a content of the exhaust gases, wherein the discharging zone is configured to not remove the material from the rotary bed upon the analyzing apparatus determining that a combustion of the material has not occurred to a threshold extent.

18. A rotary bed electric furnace, comprising:

a rotary bed having a material carrying surface configured to carry material to be heated in the rotary bed electric furnace, and a rotator configured to rotate the rotary bed so that material carried on the material carrying surface of the rotary bed passes through peripheral zones of the rotary bed electric furnace, wherein the peripheral zones include:

a feeding zone configured to receive the material on the material carrying surface of the rotary bed, a drying zone configured to receive the material carried on the material carrying surface of the rotary bed from the feeding zone and configured to dry and heat the material carried on the material carrying surface of the rotary bed by means of electrical energy to a temperature between 50 and 300° C., a heating zone configured to receive the material carried on the material carrying surface of the rotary bed from the drying zone and configured to heat the material carried on the material carrying surface of the rotary bed by means of electrical energy to a temperature between 300 and 700° C., a cooling zone configured to receive the material carried on the material carrying surface of the rotary bed from the heating zone and configured lower the temperature of the material carried on the material carrying surface of the rotary bed and configured to release gases from the material carried on the material carrying surface of the rotary bed, and a discharging zone configured to receive the material carried on the material carrying surface of the rotary bed from the cooling zone and configured to discharge the material carried on the material carrying surface of the rotary bed from the material carrying surface of the rotary bed, the drying zone being covered by a first section hood configured to prevent gases from escaping from the drying zone, the heating zone being covered by a second hood section configured to prevent gases from escaping from the heating zone, the cooling zone being covered by a third hood section configured to prevent gases from escaping from the cooling zone, a first curtain arrangement between the feeding zone and the drying zone to prevent exhaust gases from escaping from the furnace between the feeding zone and the drying zone, and a second curtain arrangement between the cooling zone and the discharging zone to prevent exhaust gases from escaping from the furnace between the cooling zone and the discharging zone, the rotary bed electric furnace further comprising an analyzing apparatus configured to analyze at least one of a color of the material or a content of the exhaust gases, wherein the feeding zone is configured to not feed new material onto the rotary bed upon the analyzing apparatus determining that a combustion of the material has not occurred to a threshold extent.

* * * * *